US006481236B2

(12) United States Patent
Glenk

(10) Patent No.: US 6,481,236 B2
(45) Date of Patent: Nov. 19, 2002

(54) CONTAINER WITH A COOLING MODULE

(75) Inventor: Hans Georg Glenk, Puchheim (DE)

(73) Assignee: Linde Gas AG (DE)

( * ) Notice: Subject to any disclaimer, the term of this patent is extended or adjusted under 35 U.S.C. 154(b) by 0 days.

(21) Appl. No.: 09/943,740

(22) Filed: Sep. 4, 2001

(65) Prior Publication Data

US 2002/0040586 A1 Apr. 11, 2002

(30) Foreign Application Priority Data

Sep. 1, 2000 (DE) ..... 100 43 508

(51) Int. Cl.[7] ..... F25D 3/08
(52) U.S. Cl. ..... 62/371; 62/457.9; 62/530
(58) Field of Search ..... 62/371, 383, 377, 62/457.1, 457.2, 457.9, 530, 78, 62, 60

(56) References Cited

U.S. PATENT DOCUMENTS

| | | | | | |
|---|---|---|---|---|---|
| 2,850,885 | A | * | 9/1958 | Mohr et al. | 62/372 |
| 5,417,082 | A | * | 5/1995 | Foster et al. | 62/457.1 |
| 5,570,588 | A | * | 11/1996 | Lowe | 62/457.7 |
| 6,119,476 | A | * | 9/2000 | Slaughter et al. | 62/371 |
| 6,205,794 | B1 | * | 3/2001 | Brothers | 62/51.1 |

* cited by examiner

*Primary Examiner*—Denise L. Esquivel
*Assistant Examiner*—Melvin Jones
(74) *Attorney, Agent, or Firm*—Millen, White, Zelano & Branigan, P.C.

(57) ABSTRACT

The invention relates to a container with at least one cooling module for receiving a coolant, characterized in that the cooling module is designed as a hollow wall that is attached at least partially in the area of the side wall container, whereby the hollow wall is provided for receiving coolant.

19 Claims, 3 Drawing Sheets

CONTAINER WITH A COOLING MODULE

The invention relates to a container with at least one cooling module, which has means for receiving a coolant.

Known are cold-retaining devices for storage and for transport of refrigerated goods, in which liquefied gases are used as coolants. In this case, it is common to introduce into a drawer-like reservoir the liquid gas at the upper end of a container to be cooled. Of course, in this case cold is released via the partition of the reservoir into the refrigerated goods in the cold locker, and evaporated coolant is vented into the cold locker for additional product cooling. In this arrangement, however, drawbacks occur: On the one hand, it is necessary to take expensive precautions for preventing the penetration of liquid coolant into the cold locker, since the refrigerated goods can be damaged as a result. On the other hand, because of the limited surface area, which the underside of a known drawer-like reservoir offers, the heat transfer through the partition is unsatisfactory for various applications, for example if a quick cooling of introduced refrigerated goods or an especially uniform temperature distribution is important.

In this connection and below, the term cooling is used for cooling-off and cold retention above and below the freezing point of water.

SUMMARY OF THE INVENTION

An object of this invention is to make available a device for cooling that is safe for the product and suitable for the requirements of the refrigerated goods and that can be operated independently of an energy supply and is therefore especially suitable for transport and for storage of refrigerated goods.

This object is achieved according to the invention in that the cooling module is designed as a hollow wall that is attached at least partially in the area of the side wall of the container, whereby the hollow wall is provided for receiving coolant. For example, the hollow wall is designed as a hollow U-profile, which is filled with liquid coolant. With this configuration, a large surface area is made available, through which a heat exchange takes place. The refrigerating capacity of the coolant that is used thus can be optimally used.

The cooling module preferably has means for releasing coolant vapor into the interior space of the container. By contact with the coolant vapor, the refrigerated goods are advantageously cooled uniformly.

Especially preferably, the cooling module is attached in the area of the side wall of the container in a vertically adjustable manner (8). The advantage thus arises that, for example, the temperature distribution can be adjusted within specific limits to the distribution of the concentration with refrigerated goods in the container.

According to a further development of the invention, the cooling module is designed with guide rails (9) to move horizontally along the side wall of the container. This embodiment makes possible a simple change of a cooling module, as well as a removal of the cooling module from the container, for example for cleaning purposes.

According to another embodiment of the invention, the cooling module is integrated into the container wall in the area of the side wall of the container. This has the advantage of being especially space-saving. The container wall toward the outside is preferably well insulated. Especially preferred is a vacuum isolation.

Advantageously, the interior space of the container is divided into at least two areas by at least one horizontal separating layer. The cooling module is designed especially advantageously so that in the various areas, different temperatures prevail. For example, the cooling module is located along the upper half of the side wall of the container, whereby a horizontal partition is attached at the level of the lower end of the cooling module. Two storage areas for refrigerated goods are thus available: a lower warmer area and an upper colder area. This is especially advantageous for storing or for transporting different types of refrigerated goods in a container.

At least one means for supplying coolant is suitably provided; this means is provided in particular in the area of the side wall of the container.

The means for supplying coolant can be connected especially suitably with a source for coolant.

According to an especially preferred embodiment of the invention, liquefied gases, especially liquid nitrogen, are provided as coolants. Carbon dioxide, especially liquid carbon dioxide, can also advantageously be used as coolant.

The container suitably has an insulation that thermally shields the container from the ambient temperature.

The container is advantageously designed so that it is suitable for the transport and/or storage of refrigerated goods, especially food that is to be cooled. Food-compatible materials, such as, for example, high-grade steel, are suitably provided.

The invention offers a whole series of advantages:

In contrast to conventional devices for maintaining the temperature of food, a cooling device that is safe for the product and suitable for the requirements of the refrigerated goods is made available with the invention. The cold gas flowing through the container provides for, i.e., a homogeneous temperature distribution in the refrigerated goods.

Independently of the position in the interior space of the container, the refrigerated goods can be cooled uniformly. The good capacity to be metered of the liquid gas that is used contributes decisively to the fact that the use of coolant can be reasonably minimized. Moreover, because of the large surface area of the cooling module, the container according to the invention makes possible a very good heat transfer and a uniform temperature distribution, as well as an efficient use of the available refrigerating capacity. In addition, the possibility of dividing the interior space of the container into different cooling areas represents a great advantage for the storage of different refrigerated goods in a container.

In addition, the device according to the invention is extremely well suited for transport cooling. It can be operated independently of a permanent energy supply in the cold-retention phase. Moreover, the design of the device which consists of a few components is selected to be simple and sturdy, which complies with the requirements of a transport container with respect to transport weight and durability.

Below, the invention is to be explained in more detail based on the embodiments that are depicted diagrammatically in the figures.

BRIEF DESCRIPTION OF THE DRAWINGS

FIG. 2 shows a horizontal partition (5), which is designed as an insulating plate or as a eutectic plate. For example, the container is designed so that in the area above partition (5), a temperature of +1° C. to +3° C. prevails, and in the area below partition (5), a temperature of +5° C. to +7° C. prevails.

Figure 1:
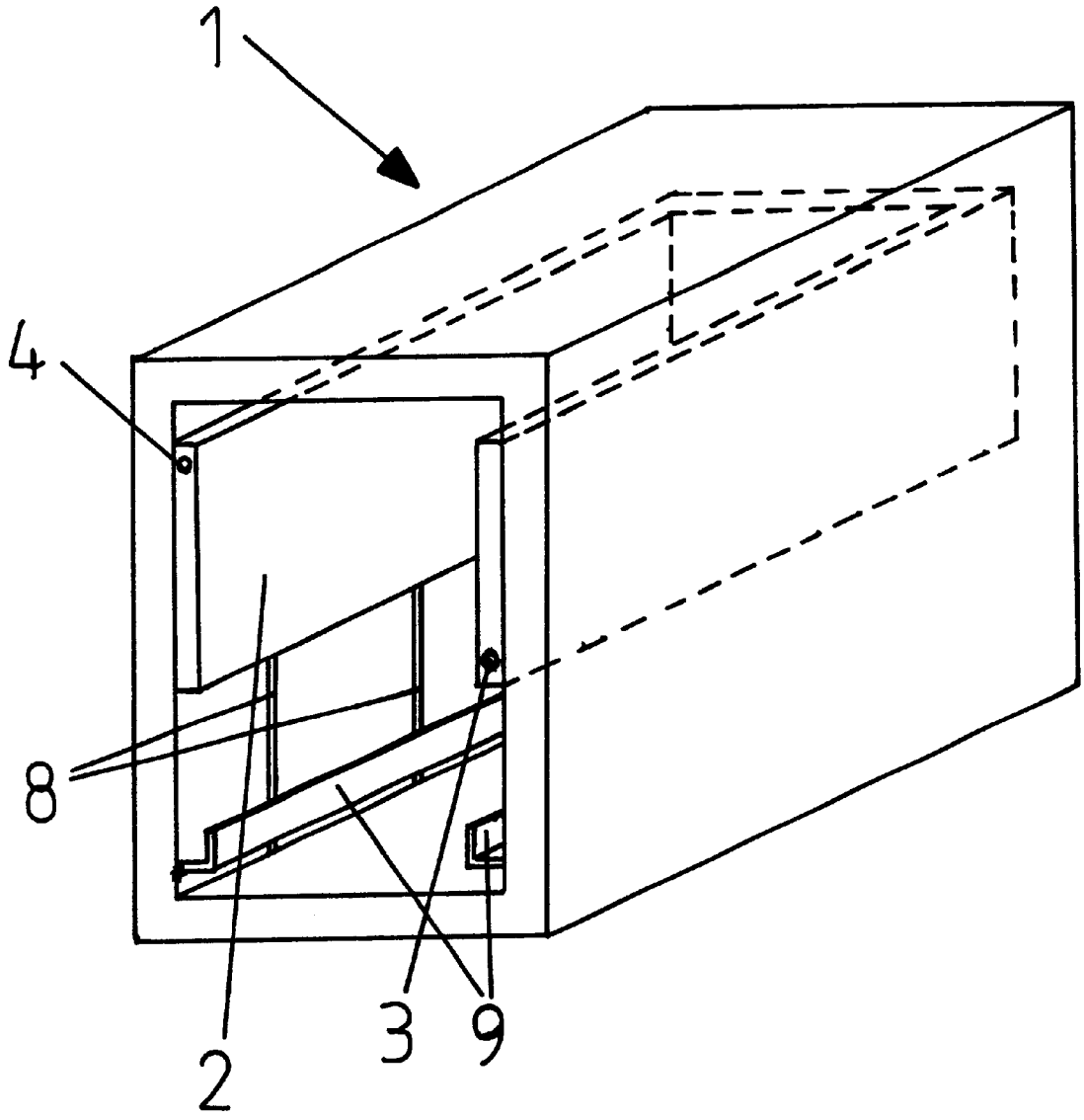
FIG. 1 shows a container (1) according to the invention with a cooling module (2), which has a feed (3) for coolant and a means (4) for releasing coolant vapor into the interior of container (1).
Figure 2:
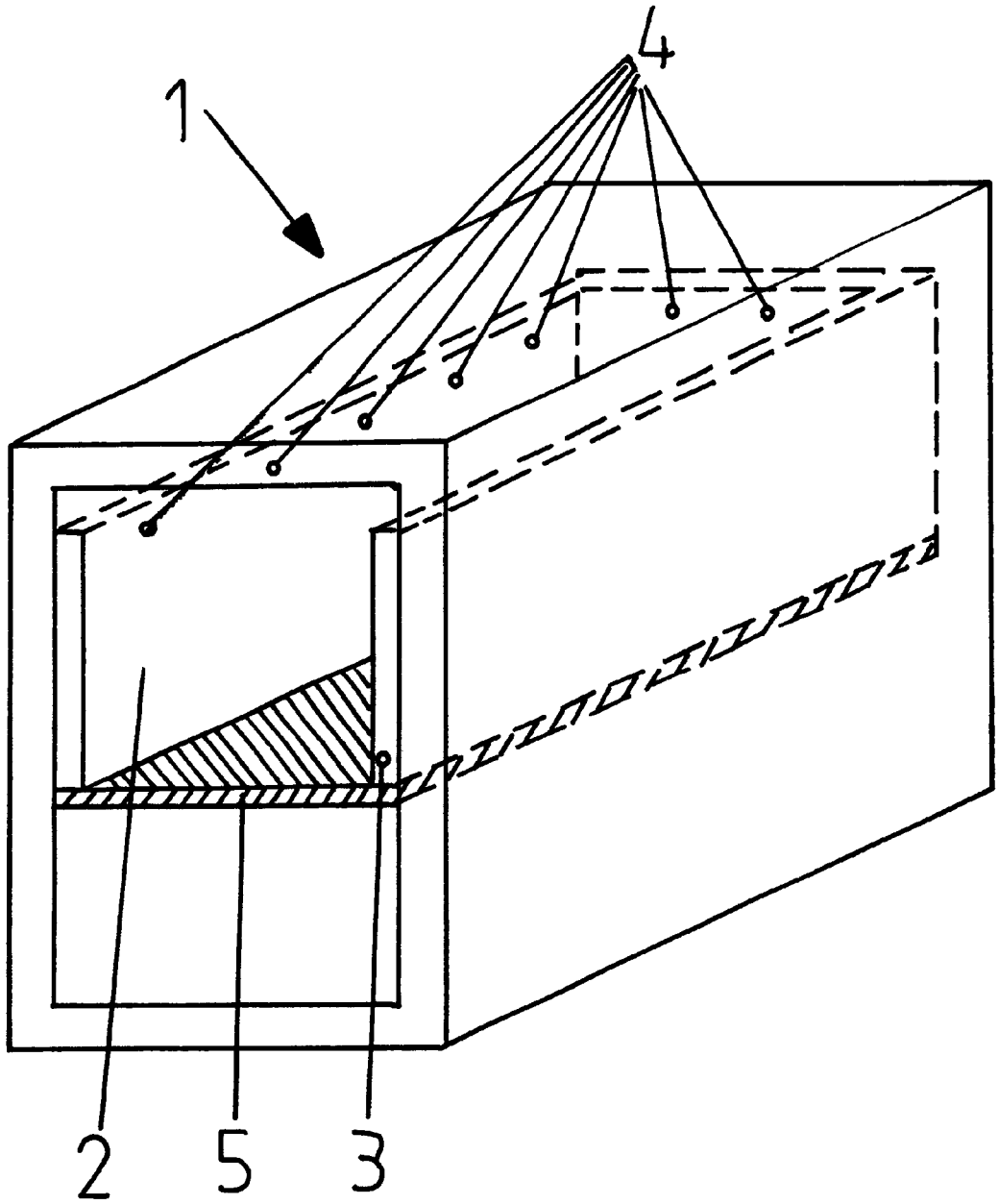
FIG. 2 shows a container (1) according to the invention with a cooling module (2), which has several means (4) for releasing coolant vapor into the interior of container (1). By this arrangement, a uniform distribution of the gaseous coolant in container (1) is achieved. In addition.
Figure 3:
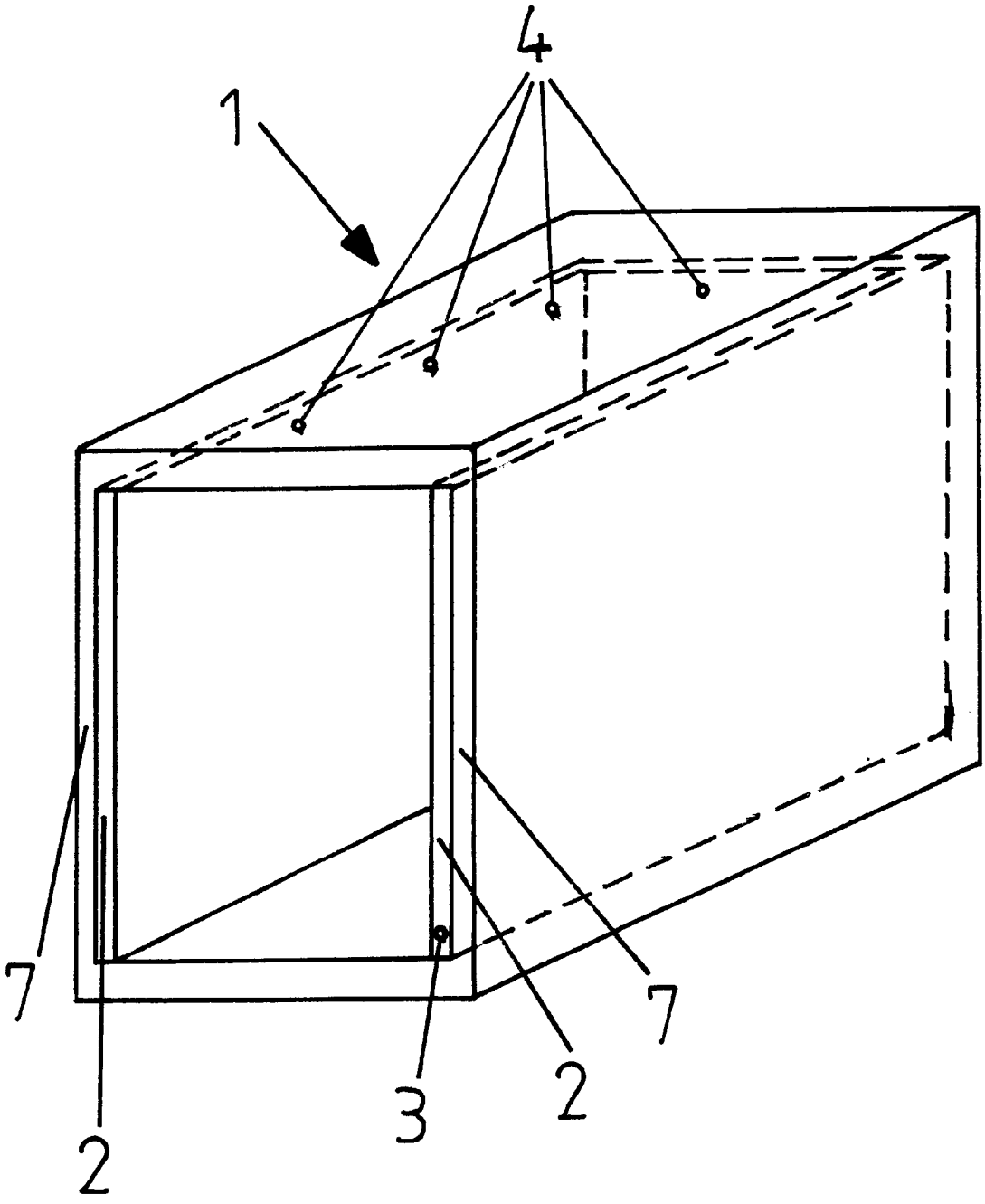
FIG. 3 shows a container (1) according to the invention, in whose side wall a cooling module (2) is integrated. Moreover, the side walls have an insulation (7).

The preceding specific embodiments are to be construed as merely illustrative, and not limitative of the remainder of the disclosure in any way whatsoever.

The entire disclosure of all applications, patents and publications, cited above and below, as well as German application 10043508.4 filed Sep. 1, 2000, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A container (1) with at least one side wall and at least one cooling module (2), which has means for receiving a coolant, wherein the cooling module (2) comprises a hollow wall that is attached at least partially in the area of at least one side wall of container (1), whereby said hollow wall is capable of receiving coolant and an interior space of the container (1) is divided into at least two areas by at least one horizontal separating layer (5).

2. A container (1) according to claim 1, wherein cooling module (2) has means (4) for releasing coolant vapor to the interior space of container (1).

3. A container (1) according to claim 2, wherein at least one feed means (3) for supplying coolant is provided, in the area of a side wall of container (1).

4. A container (1) according to claim 1, wherein cooling module (2) is attached in the area of at least one side wall of container (1) in a vertically adjustable manner (8).

5. A container (1) according to claim 4, wherein at least one feed means (3) for supplying coolant is provided, in the area of a side wall of container (1).

6. A container (1) according to claim 1, wherein cooling module (2) comprises guide rails (9) to move horizontally along at least one side wall of container (1).

7. A container (1) according to claim 6, wherein at least one feed means (3) for supplying coolant is provided, in the area of a side wall of container (1).

8. A container (1) according to claim 1, wherein cooling module (2) is integrated into at least one container wall in the area of at least one side wall of container (1).

9. A container (1) according to claim 8, wherein at least one feed means (3) for supplying coolant is provide, in the area of a side wall of container (1).

10. A container (1) according to claim 1, wherein cooling module (2) is designed so that different temperatures prevail in the various areas.

11. A container (1) according to claim 1, wherein at least one means (3) for supplying coolant is provided, in the area of a side wall of container (1).

12. A container (1) according to claim 8, wherein means (4) for supplying coolant can be connected with a source for coolant.

13. A container (1) according to claim 1, wherein liquefied gases are provided as coolant.

14. A container (1) with a least one side wall and at least one cooling module (2), which has at least one inlet for receiving a coolant, wherein the cooling module (2) comprises a hollow wall that is attached directly to at least one side wall of container (1), whereby said hollow wall is capable of receiving coolant.

15. A container (1) according to claim 1, wherein container (1) has an insulation (7).

16. A container (1) according to claim 1, wherein container (1) is suitable for the transport and/or storage of refrigerated goods.

17. A container (1) according to claim 1, wherein liquid nitrogen is provided as coolant.

18. A container (1) according to claim 1, wherein cooling module (2) has at least one outlet for releasing coolant vapors to the interior space of container (1).

19. A container (1) according to claim 1, wherein at least one feed means (3) for supplying coolant is provided, in the area of a side wall of container (1).

* * * * *

UNITED STATES PATENT AND TRADEMARK OFFICE

CERTIFICATE OF CORRECTION

PATENT NO. : 6,481,236 B2
DATED : November 19, 2002
INVENTOR(S) : Hans Georg Glenk It is certified that error appears in the above-identified patent and that said Letters Patent is hereby corrected as shown below:

Column 4,
Line 19, reads "according to claim 8" should read -- according to claim 11 --

Signed and Sealed this

Twenty-first Day of October, 2003

JAMES E. ROGAN
*Director of the United States Patent and Trademark Office*